US005341744A

United States Patent [19]

Shi

[11] Patent Number: 5,341,744

[45] Date of Patent: Aug. 30, 1994

[54] CLEANING SHELL FOR FIREARMS

[76] Inventor: Xiao Shi, 3 Coleman St., 2A, West Haven, Conn. 06516

[21] Appl. No.: 20,430

[22] Filed: Feb. 22, 1993

[51] Int. Cl.[5] ..... F42B 5/24

[52] U.S. Cl. ..... 102/442; 102/430; 102/440; 102/529; 42/95

[58] Field of Search ..... 102/430, 440, 442, 443, 102/529; 42/95; 15/104.5; 124/57, 71; 222/3

[56] References Cited

U.S. PATENT DOCUMENTS

| | | | |
|---|---|---|---|
| 938,836 | 11/1909 | Fessenden | 102/442 |
| 1,495,008 | 5/1924 | Feagin | 102/442 |
| 2,375,314 | 5/1945 | Mills | 124/57 |
| 2,981,026 | 4/1961 | Wedral | 222/5 |
| 3,830,214 | 8/1974 | Curtis | 124/57 |
| 5,078,117 | 1/1992 | Cover | 102/440 |

FOREIGN PATENT DOCUMENTS

| | | | |
|---|---|---|---|
| 2599827 | 12/1987 | France | 42/95 |

*Primary Examiner*—Harold J. Tudor
*Attorney, Agent, or Firm*—Bachman & LePointe

[57] ABSTRACT

An apparatus for cleaning the bore of a firearm including a shell housing having a rearwardly oriented base portion, a substantially tubular body defining a cavity, and a forward end, a tank for confining a compressed fluid, the tank being disposed within the cavity of the housing, a cleaning wad for cleaning the bore of the firearm, disposed forward of the tank, and a rupturing member disposed between the tank and the cleaning wad, whereby the compressed fluid is released from the tank and propels the cleaning wad through the bore of the firearm.

17 Claims, 2 Drawing Sheets

CLEANING SHELL FOR FIREARMS

BACKGROUND OF THE INVENTION

The invention relates to the field of firearms and, more particularly, to a shell for cleaning the bore of a firearm.

The discharge of conventional firearms results in deposits of residue on the inside surface of the bore of the firearm. Such deposits, over time, can damage the firearm, impair its performance, and lead to potentially dangerous conditions.

The cleaning of the bore of a firearm by conventional means is a tedious process wherein cleaning wads attached to rods are doused with cleaning solution and run through the bore. Such conventional cleaning is not conveniently effected during hunting trips or tournaments, because of the time involved and the extra hardware which must be carried by the operator of the firearm.

Numerous devices have been developed to attempt to simplify the cleaning of the bore of firearms. Examples of such devices are disclosed in U.S. Pat. Nos. 4,998,368, 4,328,632, 3,740,883 and 3,476,047.

U.S. Pat. No. 4,328,632 to Beers discloses an apparatus for cleaning firearms which has a cartridge of pressurized gas having a puncturable cap. The cartridge is disposed in the firearm with the cap facing the firing pin. Operation of the firing pin is said to puncture the cap causing the thus released pressurized gas to propel the cartridge through the bore of the gun. Cleaning materials are disposed in the bore ahead of the cartridge and are pushed through the bore by the cartridge. However, such a device, when used, results in the cartridge becoming a potentially hazardous projectile. Further, the cartridge must contain gas sufficiently pressurized so as to propel the entire cartridge through the bore of the firearm. The cap of the cartridge must be of sufficient thickness to contain this pressure, which may interfere with the required puncturing of the cap by the firing pin. Further, the firing pin of modern firearms is generally too small to form a large enough puncture in the cap. With these numerous complications, it is apparent that the cartridge could easily become jammed in the bore of the firearm. Finally, such a device may not be suitable for larger caliber guns or firearms where the size and required pressure of the cartridge would become impractical.

U.S. Pat. No. 4,998,368, to Blase, discloses a cleaning device including a compressed gas cartridge disposed in the firing chamber of the firearm and having a cleaning wad releasably disposed at the end of the tank. A cap of the tank is punctured by the firing pin of the firearm, to release the compressed gas and flush the cleaning wad through the bore. This device is said to overcome disadvantages inherent in the other mentioned patents such as the potentially hazardous discharge of heavy elements of the cleaning device from the bore of the firearm (see, for example, U.S. Pat. No. 4,328,632 to Beers).

Blase '368, however, also has drawbacks. The orientation of the cartridge to align the cap of the cartridge with the firing pin results in an acceleration of the cartridge towards the bore. It is said, in Blase, that the cartridge is held in place by a flange at the base of the cartridge and by a restriction in diameter of the gun bore. It appears, however, that special structure would be required to grip the flange, and that a conventional firearm, without such special structure, would have to rely on the reduction in diameter of the bore to restrain the cartridge. This, however, is likely to lead to damage to the bore from impact with the cartridge.

Furthermore, in Blase the compressed gas flows around the cartridge to the bore. This flow may be significantly interfered with due to the small flow space between the cartridge and the cartridge chamber. The flow may be further interfered with by the tendency for the cartridge to press against or seat against the reduction in diameter of the bore, thus serving as a valve to throttle or totally block flow.

Finally, in Blase, the firing pin hits against a pin in the apparatus which transmits the force of the pin to the cap to puncture the cap. In order to properly transmit this force, the intermediate pin must be of a hard metal, rather than the soft material typical of conventional primers. Impact of the firing pin with the hard metal intermediate pin over continued use would lead to excessive wear and/or damage to the firing pin.

It is clear that the need still exists for a device for cleaning the bore of a firearm which is effective to clean the bore of the firearm, and convenient to use, which does not involve the discharge of potentially dangerous projectiles from the firearm, and which does not require modification to the firearm or cause damage to the bore of the firearm to be cleaned.

It is therefore the principal object of the invention to provide an apparatus which is effective, convenient, and safe for use in cleaning the bore of a firearm.

It is a further object of the invention to provide such an apparatus, the use of which does not require modification of the firearm or special equipment.

It is a still further object of the invention to provide such an apparatus which does not damage the bore of the firearm.

It is another object of the invention to provide such an apparatus which is similar in use to a conventional round of ammunition.

Other objects and advantages will appear hereinbelow.

SUMMARY OF THE INVENTION

The foregoing objects and advantages are readily obtained by the present invention.

According to the invention, an apparatus for cleaning the bore of a firearm comprises: a shell housing having a rearwardly oriented base portion, a substantially tubular body defining a cavity, and a forward end; tank means for confining a compressed fluid, the tank means being disposed within the cavity of the housing; cleaning means for cleaning the bore of the firearm disposed forward of the tank means; and means for rupturing the tank means located between the cleaning means and the tank means, whereby the compressed fluid is released from the tank means and propels the cleaning wad through the bore of the firearm.

According to the invention, the tank means may preferably be slidably disposed within the housing, the apparatus further including means for displacing the tank means toward the rupturing means so as to rupture the tank means.

BRIEF DESCRIPTION OF THE DRAWINGS

A detailed description of the preferred embodiments of the invention follows, with reference to the attached drawings, wherein.

DETAILED DESCRIPTION

The invention relates to a cleaning shell for use in cleaning debris from the bore of a firearm. Such debris accumulates in a firearm during use and must be removed regularly to avoid damage to the firearm and to prevent unsafe operating conditions.

Figure 1:
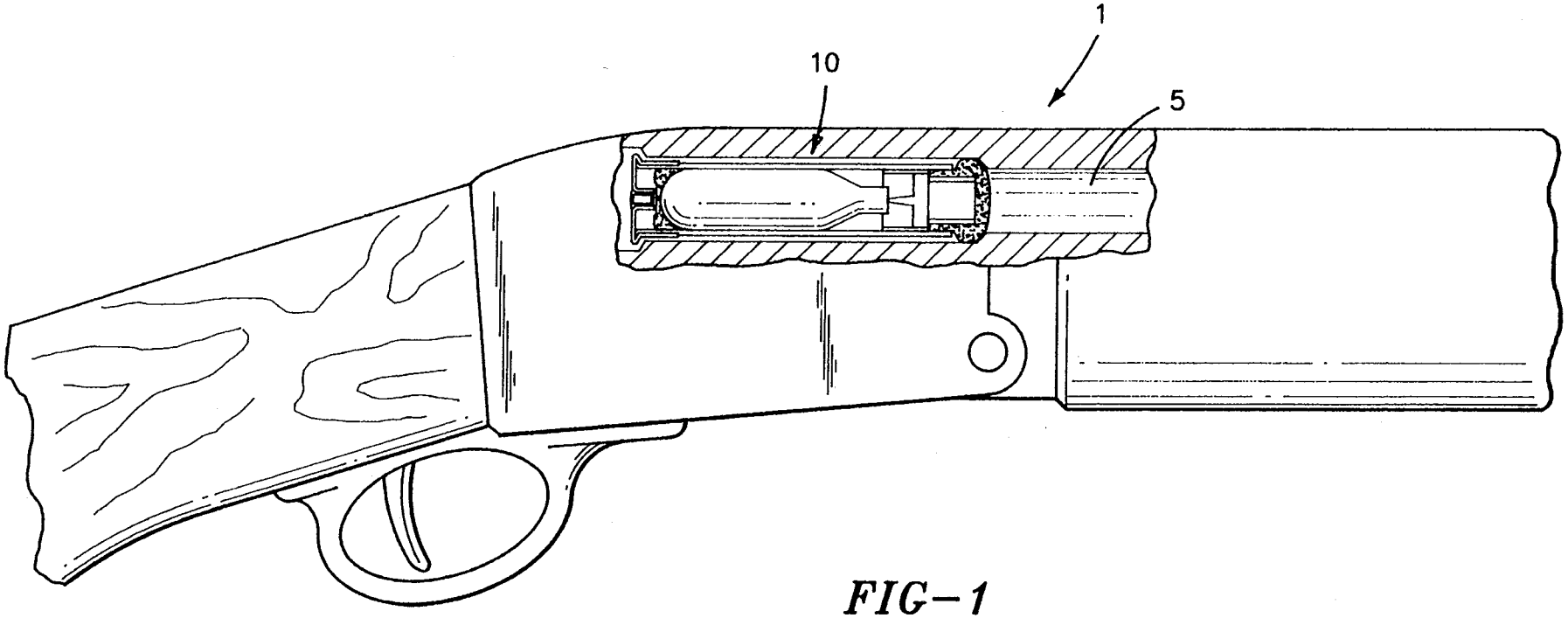
FIG. 1 shows a cleaning shell, according to the invention, disposed for use in a firearm.

According to the invention, and referring to FIG. 1, a cleaning shell 10 is provided which is loaded into a firearm 1 in the same manner as a conventional round of ammunition and which, upon discharge, forces cleaning material down or through the bore 5 of the firearm 1 to remove debris and clean the bore 5.

Figure 2:
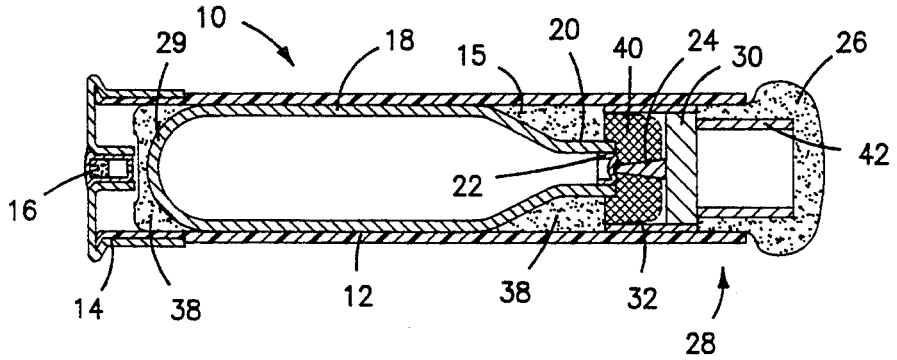
FIG. 2 is a cross-section of an apparatus according to the invention.

FIG. 2 illustrates a preferred embodiment of a cleaning shell 10 according to the invention. Cleaning shell 10 has a shell housing 12 which may preferably be of the same or similar size as a shell or cartridge for the firearm to be cleaned. Shell housing 12 has a base portion 14 and a substantially tubular body defining a cavity 15 therein. Housing 12 preferably has a conventional primer 16 disposed therein for detonation by the firing pin or firing mechanism (not shown) of the firearm. Primer 16 is preferably a non-corrosive primer so that detonation of the primer will not further contaminate the bore of the firearm. A tank 18 or cartridge is disposed within shell housing 12. Tank 18 is charged with and confines a compressed fluid, and preferably has an outlet end 20 having a cap 22.

A rupturing or puncturing member such as pin 24 is also disposed within housing 12, and is arranged in proximity or substantially adjacent to and forward of cap 22. Cleaning materials such as cleaning wad 26 are disposed in housing 12, preferably in an open or forward end 28 of housing 12. Pin 24 is preferably disposed between tank 18 and cleaning wad 26.

According to the invention, tank 18 is oriented within housing 12 so that outlet end 20 faces open end 28 of housing 12. The blunt end or head end 29 of tank 18 is arranged proximate to primer 16. In this manner when primer 16 is detonated, tank 18 is pressed toward pin 24 so that pin 24 punctures cap 22. When cap 22 is punctured, the pressurized fluid contained in tank 18 is released and drives cleaning wad 26 out of the open end 28 of housing 12 and through the bore of the firearm to be cleaned. With this configuration, and advantageously, when the cleaning shell 10 is triggered, the release of pressurized fluid urges tank 18 "backwards", or away from the bore of the firearm. Thus, tank 18 is not urged toward the bore and therefore cannot damage the bore or become a potentially hazardous projectile.

Pin 24 is preferably mounted to a base 30 which is disposed within housing 12. Base 30 may preferably be press fitted within a ring 32, which ring 32 is in turn mounted within housing 12 as shown. Ring 32 may be mounted within housing 12 through a press fit, or glue, or in any other convenient manner suitable to hold ring 32 firmly in place.

Ring 32 serves as a stop to hold tank 18 within housing 12 against the initial surge of primer 16.

Figure 3:
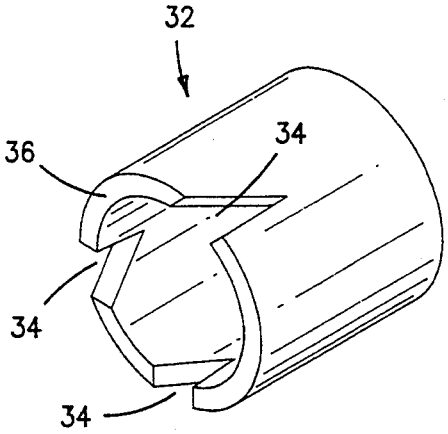
FIG. 3 is a perspective view of an element of the apparatus according to the invention.

Referring to FIG. 3, a preferred embodiment of ring 32 is illustrated. Ring 32 preferably has one or more cutouts 34 formed in an edge 36 of ring 32 which faces tank 18. Cutouts 34 serve to allow pressure generated by primer 16 to follow cleaning wad 26 and escape out of housing 12 and through the bore of the firearm when shell 10 is discharged. This is desirable because primer 16 initially forces tank 18 against ring 32 upon detonation. Contact between tank 18 and ring 32 could throttle or completely block flow out of housing 12. Cutouts 34 prevent a blockage from being formed between tank 18 and ring 32 which blockage could trap the pressure of detonation of primer 16 and radially expand housing 12, making it potentially difficult to remove the cleaning shell 10 from the firearm. Cutouts 34 release this pressure by providing a passage for the flow of gasses and thus, the release of pressure beyond ring 32 to base 30 which, as discussed below, is also dislodged by primer 16, thereby allowing pressure generated by primer 16 to escape housing 12 and follow cleaning wad 26 down the bore of the firearm.

Additional cleaning material 38 may preferably be disposed in housing 12, as shown in FIG. 2, to catch sediment formed by detonation of primer 16 and to condition escaping gasses from primer 16 so as to prevent further deposition of debris on the bore while the shell 10 is being used. Such additional cleaning material 38 may be disposed between head end 29 and primer 16, and may also be disposed around outlet end 20 of tank 18.

A screen member 40 or wire mesh may suitably be disposed in housing 12 downstream of additional cleaning materials 38 so as to hold such materials 38 within the housing 12 while allowing pressurized fluid from tank 18 to operatively flow out of shell housing 12. Screen member 40 is preferably attached to ring 32.

Cleaning wad 26 may preferably be mounted on a support 42 which support may preferably be attached to base 30 as shown in FIG. 1. In this configuration, detonation of primer 16 forces tank 18 against pin 24 to puncture cap 22. The force of primer 16 transmitted through tank 18 also dislodges base 30 from ring 32. The released pressurized fluid from tank 18 then drives base 30, pin 24, and cleaning wad 26 on support 42 out of shell 10 and through the firearm bore to be cleaned.

Suitable materials for cleaning wad 26 and additional cleaning materials 38 include any conventionally used material for cleaning the bore of a firearm such as, for example, a foam, fiber, fabric, felt, or other preferably spongy and porous material. According to the invention, such material may preferably be moistened or saturated with a cleaning solution or solvent to facilitate cleaning of the bore. Any convenient and effective cleaning solution could suitably be used such as, for example, typical gun solvent for removing metal fouling, carbon and other unburned particles. Additional cleaning materials 38 are preferably treated with a cleaning solution which is alkaline in nature so that, if a non-corrosive primer is not available, gasses from primer 16, which are generally acidic, are neutralized or conditioned so as to prevent damage to the bore of the firearm. Additional cleaning material 38 which is closest to primer 16 is preferably treated with a non-flammable or combustion resistant cleaning solution such as motor oil.

Cleaning wad 26 preferably has a diameter which exceeds the diameter of the bore to be cleaned so that debris in the bore is more readily loosened and removed by wad 26 and the cleaning solution.

A suitable tank 18 may be of any type which is convenient and suitable. For example, conventional and readily available $CO_2$ cartridges are well suited to application in the present invention. Such tanks may be rechargeable or suitable for a single use and disposal. The pressurized fluid may be any of numerous pressurized gasses or even gas/liquid mixtures. Suitable gasses preferably include any non-corrosive or inert gasses. $CO_2$ is specifically suitable because it is readily available. According to a preferred embodiment, the pressurized fluid contains cleaning solution as well, which cleaning solution furthers the effective cleaning of the firearm bore.

The rupture of cap 22 will require tank 18 to be forced against pin 24 with a force of a certain magnitude. The press fit of base 30 within ring 32 will allow the base 30 to be dislodged through the application of a force of another magnitude. According to a preferred embodiment of the invention, the magnitude of force necessary to dislodge base 30 is greater than that required to rupture cap 22. Further, the magnitude of force applied to tank 18 by detonation of primer 16 is preferably greater than both the rupturing magnitude and the dislodging magnitude.

In this configuration, obtained by selecting proper primer 16 and pressure in tank 18, as well as the proper press fit of base 30 within ring 32 and the proper pin 24 and cap 22, primer 16 advantageously generates force sufficient only first to puncture tank 18 and then dislodge base 30 from ring 32, and the release of pressurized fluid is strong enough to drive base 30 with attached cleaning wad 26 through the bore to be cleaned. Ring 32, as set forth above, is disposed within housing 12 so as to remain in place against the force of primer 16.

In this configuration, the apparatus according to the invention operates as follows. The shell 10 is disposed in the chamber of a firearm to be cleaned, for example as illustrated in FIG. 1. When the trigger is pulled, the firing pin of the firearm detonates primer 16. Primer 16 forces tank 18 against pin 24 to rupture cap 22. Once cap 22 is punctured, the force of primer 16 continues to force tank 18 towards pin 24 until base 30, attached to pin 24, is dislodged from ring 32. Ring 32 catches tank 18, and pressurized fluid is released from the tank. This pressurized fluid flows toward bore 5, and forces cleaning wad 26, base 30 and pin 24 through bore 5 to clean the firearm.

Figure 4:
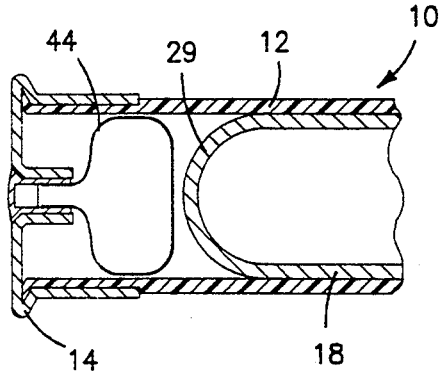
FIG. 4 is a cross-section of an alternate embodiment of the invention.

Referring to FIG. 4, an alternate embodiment of the invention replaces primer 16 with an additional compressed fluid vessel 44. Vessel 44 is made of a readily rupturable material such as glass or a suitable plastic, and contains any pressurized fluid such as, for example, compressed air. The firing mechanism (not shown) of the firearm breaks vessel 44 and releases the compressed air therein to force tank 18 against pin 24 so as to puncture cap 22, and thence to dislodge base 30 from ring 32. This embodiment avoids the use of a carbon based primer 16 which, as previously mentioned, can itself introduce further sediment to the firearm bore. It is noted that with this configuration, additional cleaning material 38 and screen member 40 may not be necessary or desired.

Figure 5:
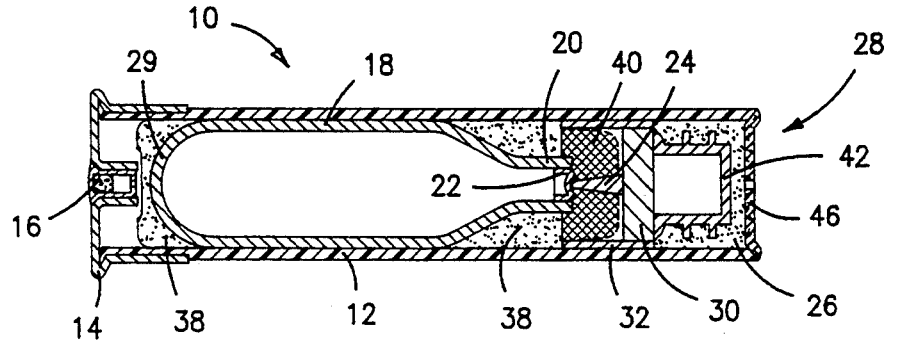
FIG. 5 is a cross-section of another alternate embodiment of the invention.

Referring to FIG. 5, an alternate embodiment of the invention is illustrated where a shell cap 46 is removably disposed over forward or open end 26 of housing 12. In this configuration, cleaning wad 26 is disposed entirely within housing 12 and shell cap 46 and can be pre-treated with cleaning solution which will not dry up and which will be held within housing 12 by cap 46. Cap 46 may be a layer of material such as wax or thin plastic which is readily displaced by discharge of shell 10. Cap 46 may alternatively be a manually or slidably removable cap suitably made of any convenient material, which cap 46 is removed by the user before cleaning shell 10 is loaded into the firearm. It is noted that cleaning wad 26 in this configuration may still not be disposed entirely within housing 12 and would, nevertheless, still be enclosed by cap 46. Such a cap 46 is illustrated in the embodiment of FIG. 6.

Figure 6:
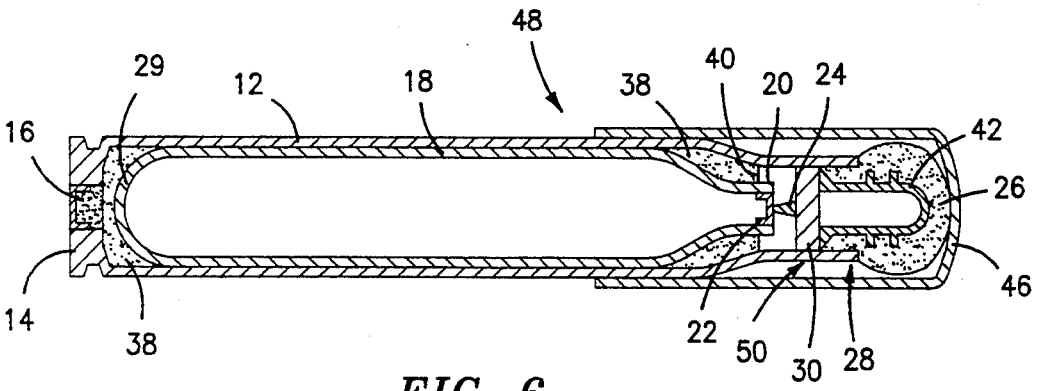
FIG. 6 is a cross-section of still another alternate embodiment of the invention.

FIG. 6 further illustrates an embodiment of the invention for use with a firearm using "cartridge" type ammunition rather than "shell" type as illustrated in FIGS. 2–5. As shown, such cartridges 48 typically have a reduced diameter portion 50 at open end 28. Thus, no seal ring 32 is necessary with cartridge 48. Other elements illustrated in FIG. 5 are of similar structure and function to similarly numbered elements of FIGS. 2–5.

In use, cleaning shell 10 may be carried by an operator of a firearm in a similar manner to conventional ammunition. When the firearm is to be cleaned, shell 10 is loaded into the chamber of the firearm like a normal round. It is noted that, particularly where cleaning wad 26 extends partially out of housing 12, the chamber will be cleaned and treated with cleaning solution as the shell 10 is loaded.

The shell 10 is then discharged by pointing the firearm in a safe direction and pulling the trigger. The cleaning wad 26 will travel through the bore of the firearm loosening debris, and cleaning same. After use, spent shell 10 can be removed just like any conventional spent shell. This procedure can be repeated if desired or necessary.

It should be noted that the cleaning shell of the present invention is useful for cleaning a wide variety of firearms including shotguns, revolvers, rifles, and even larger caliber weapons such as artillery or other types of heavy guns or the like.

It should also be noted that the use of the cleaning shell of the present invention, specifically the discharge of compressed fluids down the bore of the firearm, serves to cool the bore of the firearm. This is particularly useful when the firearm is being used in conditions of repeated firing, and especially in cooling the bore of larger caliber weapons during continued use.

In many configurations, and especially for use with shotguns, shells from "spent" conventional ammunition can be used as housing 12 and base 14 of the present invention. The cleaning shell 10 of the present invention is convenient for use in any location, is carried and used in a similar manner to conventional ammunition, and effectively cleans the bore of firearms without risking injury from potentially dangerous projectiles and without causing damage to the bore of the firearm.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for cleaning the bore of a firearm, comprising:

a shell housing having a rearwardly oriented base portion, a substantially tubular body defining a cavity, and a forward end;

tank means for confining a compressed fluid, the tank means being slidably disposed within the cavity of the housing;

cleaning means for cleaning the bore of the firearm disposed forward of the tank means;

means for rupturing the tank means located between the cleaning means and the tank means and means for connecting the rupturing means to the cleaning means whereby the compressed fluid is released from the tank means and propels the cleaning means and the rupturing means through the bore of the firearm;

means for displacing the tank means toward the rupturing means so as to rupture the tank means, the displacing means comprising a primer disposed in the cavity of the housing between the base portion of the housing and the tank means, whereby actuation of the primer causes the tank means to displace toward the rupturing means; and a ring mounted within the housing between the tank means and the forward end of the housing so as to retain the tank means in the cavity of the housing.

2. An apparatus according to claim 1, wherein the ring has at least one cutout defined in an edge facing the tank means, whereby gases released by actuation of the primer are released from the housing.

3. An apparatus according to claim 2, further including filter means, disposed within the housing between the primer and the forward end of the housing, for trapping sediment emitted from the primer and for neutralizing acidic gasses released by the primer.

4. An apparatus according to claim 3, wherein the filter means is a foam filter saturated with an alkaline cleaning solution.

5. An apparatus according to claim 4, further including a screen member, disposed in the cavity of the housing between the tank means and the cleaning means so as to retain the filter means in the housing.

6. An apparatus according to claim 5, wherein the screen member is attached to the ring.

7. An apparatus for cleaning the bore of a firearm, comprising:

a shell housing having a rearwardly oriented base portion, a substantially tubular body defining a cavity, and a forward end;

tank means for confining a compressed fluid, the tank means being slidably disposed within the cavity of the housing;

cleaning means for cleaning the bore of the firearm disposed forward of the tank means, the cleaning means comprising a cleaning material attached to a base, the base being disposed in the forward end of the housing;

means for rupturing the tank means located between the cleaning means and the tank means and mounted to the base whereby the compressed fluid is released from the tank means and propels the cleaning means and the rupturing means through the bore of the firearm;

means for displacing the tank means toward the rupturing means so as to rupture the tank means, the displacing means comprising a primer disposed in the cavity of the housing between the base portion of the housing and the tank means, whereby actuation of the primer causes the tank means to displace toward the rupturing means; and a ring mounted within the housing between the tank means and the forward end of the housing so as to retain the tank means in the cavity of the housing.

8. An apparatus according to claim 7, wherein the base is press fitted in to the ring.

9. An apparatus according to claim 8, wherein the displacing means displaces the tank means against the rupturing means with a force sufficient to rupture the tank means and sufficient to dislodge the base from the ring.

10. An apparatus according to claim 8, wherein a force of a first magnitude is necessary to rupture the tank means and a force of a second magnitude is necessary to dislodge the base from the ring, and wherein the force of the second magnitude is greater than the force of the first magnitude, whereby displacement of the tank means first ruptures the tank means and then dislodges the base.

11. An apparatus according to claim 7, wherein the shell housing is a spent shell for the firearm.

12. An apparatus according to claim 7, wherein the tank means has a forwardly oriented outlet portion facing the rupturing means, whereby the rupturing means ruptures the outlet portion to release the compressed fluid.

13. An apparatus for cleaning the bore of a firearm, comprising:

a shell housing having a rearwardly oriented base portion, a substantially tubular body defining a cavity, and a forward end;

tank means for confining a compressed fluid, the tank means being slidably disposed within the cavity of the housing;

cleaning means for cleaning the bore of the firearm disposed forward of the tank means, the cleaning means comprising a cleaning material attached to a base, the base being disposed in the forward end of the housing;

means for releasing the compressed fluid from the tank means located between the cleaning means and the tank means and mounted to the base whereby the compressed fluid propels the cleaning means and the releasing means through the bore of the firearm; and means for displacing the tank means toward the releasing means so as to operate the releasing means, the displacing means comprising a primer disposed in the cavity of the housing between the base portion of the housing and the tank means, whereby actuation of the primer causes the tank means to displace toward the releasing means.

14. An apparatus according to claim 13, wherein the releasing means comprises means for rupturing the tank means and the displacing means displaces the tank means toward the rupturing means so as to rupture the tank means.

15. An apparatus according to claim 13, further comprising a ring mounted within the housing between the tank means and the forward end of the housing so as to retain the tank means in the cavity of the housing.

16. An apparatus according to claim 15, wherein the ring is mounted at the forward end of the housing.

17. An apparatus according to claim 13, further including cap means, slidably disposed over the forward end of the shell housing so as to protect the cleaning means, whereby the cleaning means is saturated with a cleaning solution and kept ready for use.

* * * * *